US009162741B2

(12) United States Patent
Köhnsen

(10) Patent No.: US 9,162,741 B2
(45) Date of Patent: Oct. 20, 2015

(54) SURFBOARD HAVING TILT CONTROL

(71) Applicant: Benjamin Köhnsen, Hamburg (DE)

(72) Inventor: Benjamin Köhnsen, Hamburg (DE)

(73) Assignee: Sashay GmbH, Hamburg (DE)

( * ) Notice: Subject to any disclaimer, the term of this patent is extended or adjusted under 35 U.S.C. 154(b) by 0 days.

(21) Appl. No.: 14/405,608

(22) PCT Filed: Jun. 3, 2013

(86) PCT No.: PCT/EP2013/061390

§ 371 (c)(1),
(2) Date: Dec. 4, 2014

(87) PCT Pub. No.: WO2013/182523

PCT Pub. Date: Dec. 12, 2013

(65) Prior Publication Data

US 2015/0118923 A1 Apr. 30, 2015

(30) Foreign Application Priority Data

Jun. 5, 2012 (DE) ..... 20 2012 102 068 U

(51) Int. Cl.

| | |
|---|---|
| ***B63B 35/81*** | (2006.01) |
| ***B63H 11/08*** | (2006.01) |
| ***B63B 35/79*** | (2006.01) |
| *B63H 25/10* | (2006.01) |
| *B63H 25/46* | (2006.01) |
| *B63H 25/02* | (2006.01) |

(52) U.S. Cl.

CPC ..... *B63H 11/08* (2013.01); *B63B 35/7943* (2013.01); *B63B 2751/00* (2013.01); *B63H 25/10* (2013.01); *B63H 25/46* (2013.01); *B63H 2025/028* (2013.01)

(58) Field of Classification Search

USPC ..... 440/42; 441/74
IPC ..... B63B 35/7943; B63H 11/08
See application file for complete search history.

(56) References Cited

U.S. PATENT DOCUMENTS

| | | | | |
|---|---|---|---|---|
| 4,051,801 | A * | 10/1977 | Woodfill et al. | 440/1 |
| 4,817,950 | A * | 4/1989 | Goo | 463/36 |
| 5,791,276 | A * | 8/1998 | Floyd | 114/144 R |
| 5,947,788 | A * | 9/1999 | Derrah | 446/154 |
| 6,461,204 | B1 | 10/2002 | Takura | |
| 6,901,872 | B1 * | 6/2005 | Battle et al. | 114/55.56 |
| 7,207,282 | B1 | 4/2007 | Ruan | |
| 2008/0133075 | A1 * | 6/2008 | St-Pierre et al. | 701/21 |
| 2011/0256518 | A1 * | 10/2011 | Rott | 434/247 |
| 2012/0000409 | A1 | 1/2012 | Railey | |

FOREIGN PATENT DOCUMENTS

DE 20 2011 051071 11/2011

* cited by examiner

*Primary Examiner* — Stephen Avila
(74) *Attorney, Agent, or Firm* — Bay State IP, LLC

(57) ABSTRACT

The invention relates to a surfboard assembly that can be controlled, comprising a surfboard (1), which has a stern and a bow and which has a standing surface for a surfer (2), a longitudinal axis (L) oriented from the stern to the bow, a drive having a thrust device, which thrust device can be pivoted in a pivoting plane along the standing surface (13), for producing left and right cornering of the surfboard assembly, and a propulsion unit, at least one sensor (18), which is integrated in the surfboard (1) and detects tilting clockwise and counterclockwise about the longitudinal axis (L) and which controls the pivoting direction of the nozzle (12) in such a way that tilting of the surfboard (1) counterclockwise about the longitudinal axis (L) pivots the nozzle (12) to the left in the pivoting plane.

8 Claims, 2 Drawing Sheets

SURFBOARD HAVING TILT CONTROL

CROSS REFERENCE TO RELATED APPLICATION

This application is for entry into the U.S. National Phase under §371 for International Application No. PCT/EP2013/061390 having an international filing date of Jun. 3, 2013, and from which priority is claimed under all applicable sections of Title 35 of the United States Code including, but not limited to, Sections 120, 363, and 365(c), and which in turn claims priority under 35 USC 119 to German Patent Application No. 20 2012 102 068.8 filed on Jun. 5, 2012.

BACKGROUND OF THE INVENTION

1. Field of the Invention

The invention concerns a controllable surfboard arrangement.

2. Description of the Related Art

Surfboards have been known for a long time. Surfboards are in the English language use boards without sails on which a surfer can ride the advance of a wave. In the German language use, it is named "wave-riding".

Surfboards have the disadvantage that without the advance of the wave, it is not possible to carry out the water sport. Wind-surfboards in contrast also have a sail on the surfboard, which is connected with articulation to the surfboard at its lower mast end. The windsurfer can therefore use the surfboard even if there are no waves, as long as there is wind.

DE 20 2011 051 071.9 discloses surfboard arrangements which have a jet drive integrated in a surfboard, wherein the jet drive can be controlled by an integral control unit which can be held in the surfer's hand. The integrated control unit is designed for controlling both speed and turning left and right.

SUMMARY OF THE INVENTION

Starting from this prior art, the object of the present invention is to provide a surfboard which allows further improved surfing pleasure.

This object is achieved by a controllable surfboard arrangement of the type cited initially with the features of claim 1, preferred embodiments being the subject of the subclaims.

The controllable surfboard arrangement according to the invention has a surfboard with a bow and a stern, with a standing surface for a surfer and a longitudinal axis oriented from the stern to the bow. The arrangement comprises a drive with a reaction propulsion device, swivellable in a swivel plane along the standing surface, to generate the left and right turning movements of the surfboard arrangement, and a propulsion comprising at least one acceleration sensor and/or position sensor integrated in the surfboard and detecting clockwise and counterclockwise tilting about the longitudinal axis, said sensor controlling the swivel direction of the nozzle such that a counterclockwise tilt of the surfboard about the longitudinal axis swivels the nozzle to the left in the swivel plane, and in operation causes a left turn of the surfboard arrangement, and a clockwise tilting of the surfboard about the longitudinal axis swivels the nozzle to the right in the swivel plane, and in operation causes a right turn of the surfboard arrangement, and with a hand control with which the travel speed can be controlled.

The invention utilizes the concept of separating the travel speed and cornering controls physically and operationally. Firstly the surfer controls turning by a load change on the surfboard, in contrast to which the propulsion determining the speed is controlled with a hand control. By separating the turning and speed controls, surfing pleasure is increased.

In a preferred embodiment of the invention, the drive comprises a jet drive with a reaction propulsion device formed as a nozzle. Nozzles are advantageously particularly low-maintenance.

Preferably a water inlet is arranged on an underwater face of the surfboard, and the nozzle for water expulsion is arranged on an overwater face. Jet drives are proven drives for watersport devices. They can favourably be used even close to the bank or coast and in very shallow water.

In a further preferred embodiment of the invention, the at least one sensor integrated in the surfboard is configured as an acceleration sensor and position sensor. Particularly preferably, at least one acceleration sensor and position sensor is arranged in a surfboard body in a port-side region and in a starboard-side region. The at least one sensor can be connected with a controller of a servomotor of a swivel axis of the nozzle. The sensor is preferably used exclusively for directional control of the surfboard arrangement by weight shift of the surfer on the standing surface. Sensors to control the actuator are installed integrally in the surfboard body with protection. They have no contact with the water, even in operation.

In addition, preferably the hand control for the surfer is provided exclusively for changing the travel speed. The hand control can be configured as a pushbutton control but also as a tilting control or joystick. Suitably the hand control is connected via a radio connection to a control unit of an electric drive of an impeller. In this way no disruptive cable connections outside the surfboard are required.

The surfboard preferably has a battery arranged in the surfboard which powers both the actuator and the impeller drive. The battery can be charged via a conventional electricity network.

BRIEF DESCRIPTION OF THE DRAWINGS

The invention is described with reference to one exemplary embodiment shown in three figures. The drawings show:

FIGS. 1, 2 and 3 are not to scale.

DETAILED DESCRIPTION OF THE PREFERRED EMBODIMENTS

Figure 1:
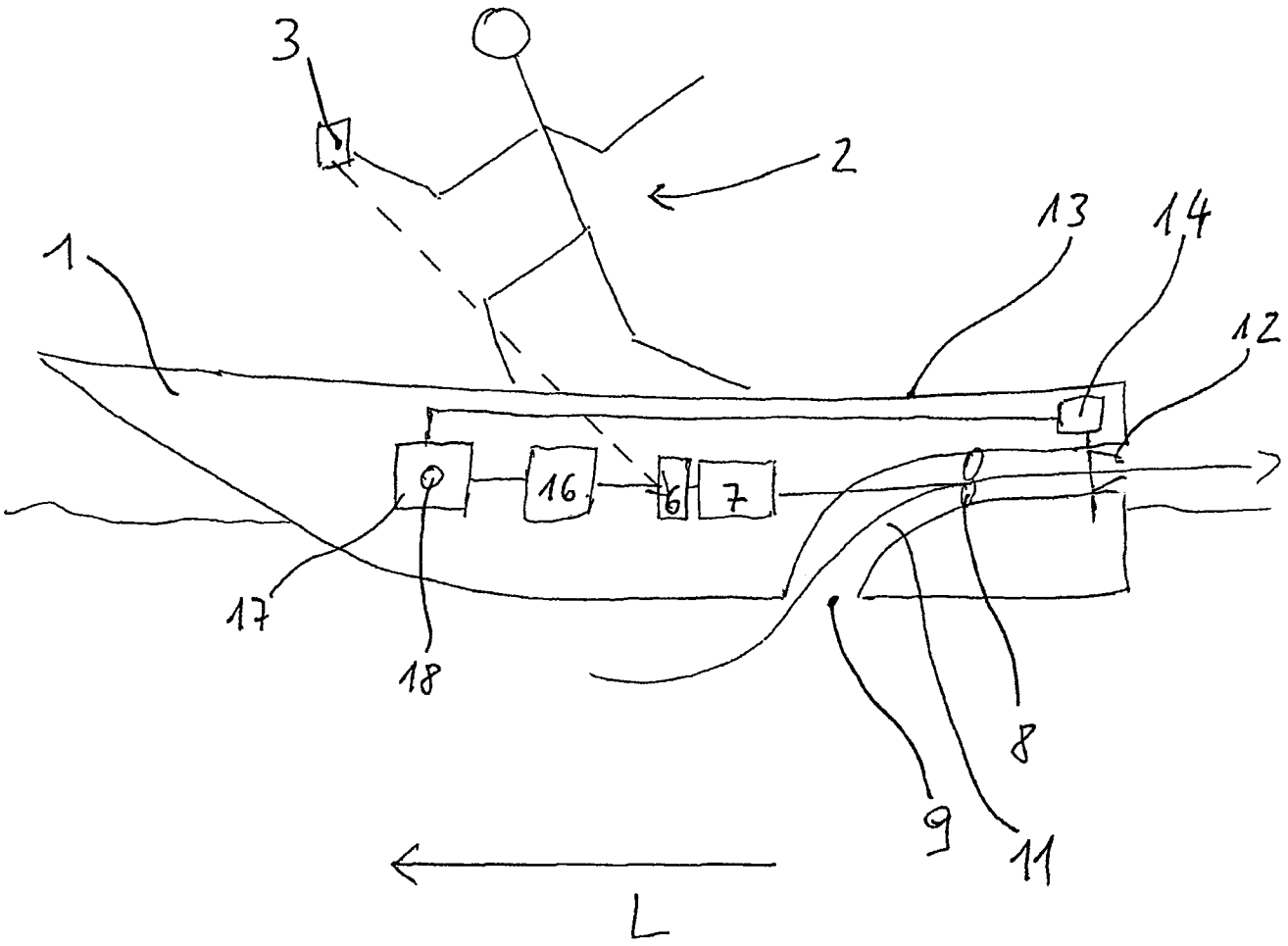
FIG. 1 a principal cross-section view in the longitudinal direction of a surfboard arrangement according to the invention with surfer, FIG. 2 a rear view of the surfboard arrangement in FIG. 1, FIG. 3 a top view in partial cross-section of the surfboard arrangement in FIG. 1.
Figure 2:
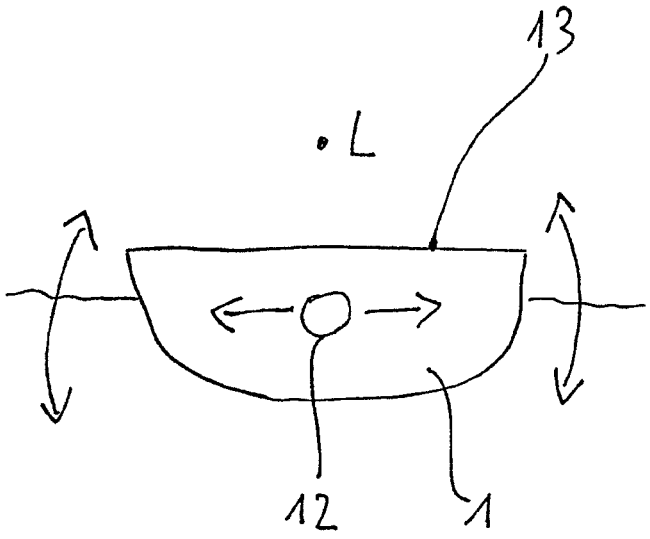

FIG. 1 shows a surfboard 1 with a surfer 2 balancing on the surfboard 1, holding a hand control 3 in his right hand, to carry out the surfing.

The hand control 3 is here configured as a pushbutton which can be activated by a finger of the server 2, and comprises a transmitter for control data generated by the pushbutton. The transmitter is connected data-conductively via a radio connection 4 to a receiver arranged inside the surfboard 1. The receiver conducts the received data to a first control unit 6 for a first electric motor 7 of an impeller 8 arranged at the stern of the surfboard 1. The hand control 3 allows the speed of the surfboard 1 to be controlled by changing the position of the pushbutton. The hand control 3 can also be configured as a joystick or as a commercial smartphone which can achieve an increase or reduction in speed by pivoting forward in the travel direction or backward towards the surfer 2.

The impeller 8 is part of a jet drive which has a water inlet 9 arranged on the underwater face of the surfboard 1. The water inlet 9 leads along a water channel 11 to the nozzle 12 which is arranged on the stern of the surfboard 1 and which can be swivelled parallel to the standing surface 13 of the surfboard 1. The impeller 8 is arranged in the water channel 11 and is driven electrically by the first electric motor 7 by means of a shaft.

The electric motor 7 is powered via a battery 16 integrated in the surfboard 1. The battery 16 can be charged via a conventional mains connection. The same battery 16 also powers an actuator 14 which is provided at the stern of the surfboard 1. The actuator 14 serves to swivel the nozzle 12. The swivel plane of the nozzle runs substantially along and preferably parallel to the standing face 13 of the surfboard 1. Swivelling the nozzle 12 causes a change in the reaction propulsion direction of the water drawn in through the water channel 11 and expelled from the nozzle 12, so that the surfboard 1 can be controlled to turn right and left.

The actuator 14 can be controlled via a second control unit 17 which is also provided inside the surfboard 1. The second control unit receives measurement data from two acceleration and position sensors 18 arranged in the edge region which detect a clockwise and counterclockwise tilting movement of the surfboard 1 travelling in the travel direction in longitudinal direction L.

Figure 3:
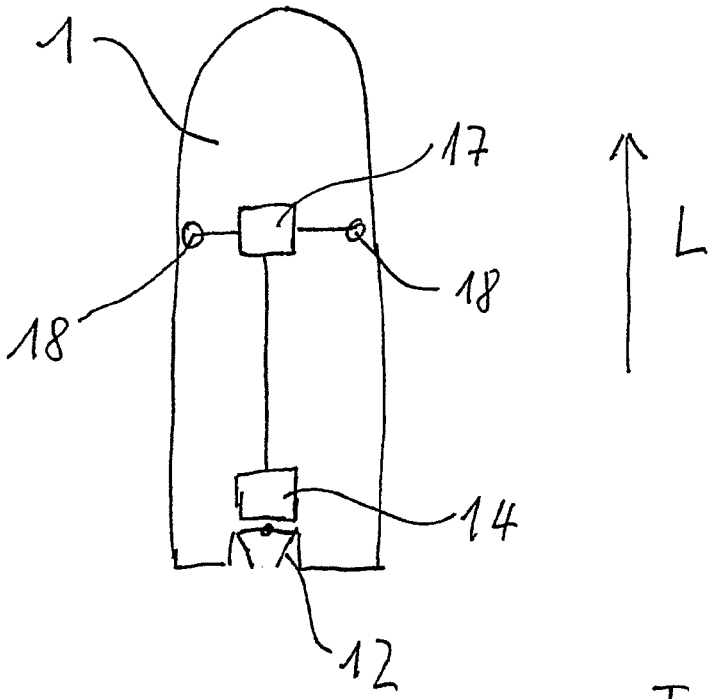

The second control unit 17 is configured such that a counterclockwise tilt movement in the travel direction swivels the nozzle 12 clockwise, viewed from the top in FIG. 3, so that the surfboard 1 is controlled to turn left, whereas conversely a clockwise tilt movement of the surfboard 1 viewed in the travel direction leads to a counterclockwise swivel of the nozzle 12, viewed from the top in FIG. 3, controlling the surfboard 1 to turn right. The turning is however preferably achieved exclusively via the tilt movement of the surfboard 1 as a whole about its longitudinal axis L, caused by the weight shift of the surfer 2. The complete separation of the second control unit 17 for turning left and right from the first control unit 6 for travel speed, increases the surfing pleasure compared with a control unit integrating turning and speed control.

LIST OF REFERENCE NUMERALS

1 Surfboard
2 Surfer
3 Hand control
4 Radio connection
6 First control unit
7 Electric motor
8 Impeller
9 Water inlet
11 Water channel
12 Swivellable nozzle
13 Standing surface of surf board
14 Actuator
16 Battery
17 Second control unit
18 Acceleration and position sensors
L Longitudinal direction/longitudinal axis

The invention claimed is:

1. Controllable surfboard arrangement with a surfboard (1) having a stern and a bow, with a standing surface for a surfer (2) and with a longitudinal axis (L) oriented from the stern to the bow, and with a drive with a reaction propulsion device which can be swivelled in a swivel plane along the standing surface (13) to generate left and right turn movements of the surfboard arrangement, and a propulsion device, with at least one sensor (18) integrated in the surfboard (1) and detecting clockwise and counterclockwise tilting about the longitudinal axis (L), which controls the swivel direction of the nozzle (12) such that a tilting of the surfboard (1) counterclockwise about the longitudinal axis (L) swivels the nozzle (12) to the left in the swivel plane and in operation causes a left turn of the surfboard arrangement, and a tilting of the surfboard (1) clockwise about the longitudinal axis (L) swivels the nozzle (12) to the right in the swivel plane and in operation causes a right turn of the surfboard arrangement, and with a hand control (3) with which the travel speed can be controlled.

2. Controllable surfboard arrangement according to claim 1, characterised in that the drive comprises a jet drive with a reaction propulsion device configured as a nozzle (12).

3. Controllable surfboard arrangement according to claim 2, characterised by a water inlet (9) arranged on an underwater face of the surfboard (1) and a water expulsion nozzle (12) arranged on an overwater face.

4. Controllable surfboard arrangement according to claim 1, characterised in that the at least one sensor integrated in the surf board (1) is configured as an acceleration and position sensor (18).

5. Controllable surfboard arrangement according to claim 4, characterised in that the at least one acceleration and position sensor (18) is arranged in a surfboard body in a port-side region and in a starboard-side region.

6. Controllable surfboard arrangement according to claim 1, characterised by a hand control (3) for the surfer (2), with which only the travel speed can be controlled.

7. Controllable surfboard arrangement according to claim 1, characterised in that the hand control (3) is connected via a radio connection (4) to a first control unit (6) of an electric drive (7) of an impeller (8).

8. Controllable surfboard arrangement according to claim 1, characterised in that the at least one sensor (18) is connected to a second control unit (17) of a servomotor (14) of a swivel axis of the nozzle (12).

* * * * *